US006900603B1

(12) United States Patent
Del Vecchio

(10) Patent No.: US 6,900,603 B1
(45) Date of Patent: May 31, 2005

(54) MOTOR CONTROL FOR SLIDE-OUT ROOM IN MOBILE LIVING QUARTERS

(76) Inventor: Thomas L. Del Vecchio, 542878 Airport Pkwy., P.O. Box 1806, Elkhart, IN (US) 46515

( * ) Notice: Subject to any disclaimer, the term of this patent is extended or adjusted under 35 U.S.C. 154(b) by 0 days.

(21) Appl. No.: 10/612,316

(22) Filed: Jul. 2, 2003

Related U.S. Application Data

(60) Provisional application No. 60/406,270, filed on Aug. 27, 2002.

(51) Int. Cl.[7] ..... A04Q 7/00

(52) U.S. Cl. ..... 318/16; 318/286; 318/282; 318/280; 318/466; 318/581

(58) Field of Search ..... 318/16, 286, 282, 318/280, 466, 468, 375, 581; 180/11; 340/825.69

(56) References Cited

U.S. PATENT DOCUMENTS

| | | | | | |
|---|---|---|---|---|---|
| 4,505,643 | A | * | 3/1985 | Millis et al. | 417/12 |
| 4,776,415 | A | * | 10/1988 | Brice | 180/11 |
| 6,300,734 | B1 | * | 10/2001 | Franke et al. | 318/286 |
| 2003/0089296 | A1 | * | 5/2003 | Haynes | 116/28 R |

* cited by examiner

*Primary Examiner*—Karen Masih

(57) ABSTRACT

A wireless DC control device including a radio frequency transmitter, receiver, and switching circuit controls the current and polarity of the current that is used to power DC motors used in mobile living quarters. The control device has particular application for controlling the extension and retraction of slide-out rooms in a mobile living quarters.

4 Claims, 12 Drawing Sheets

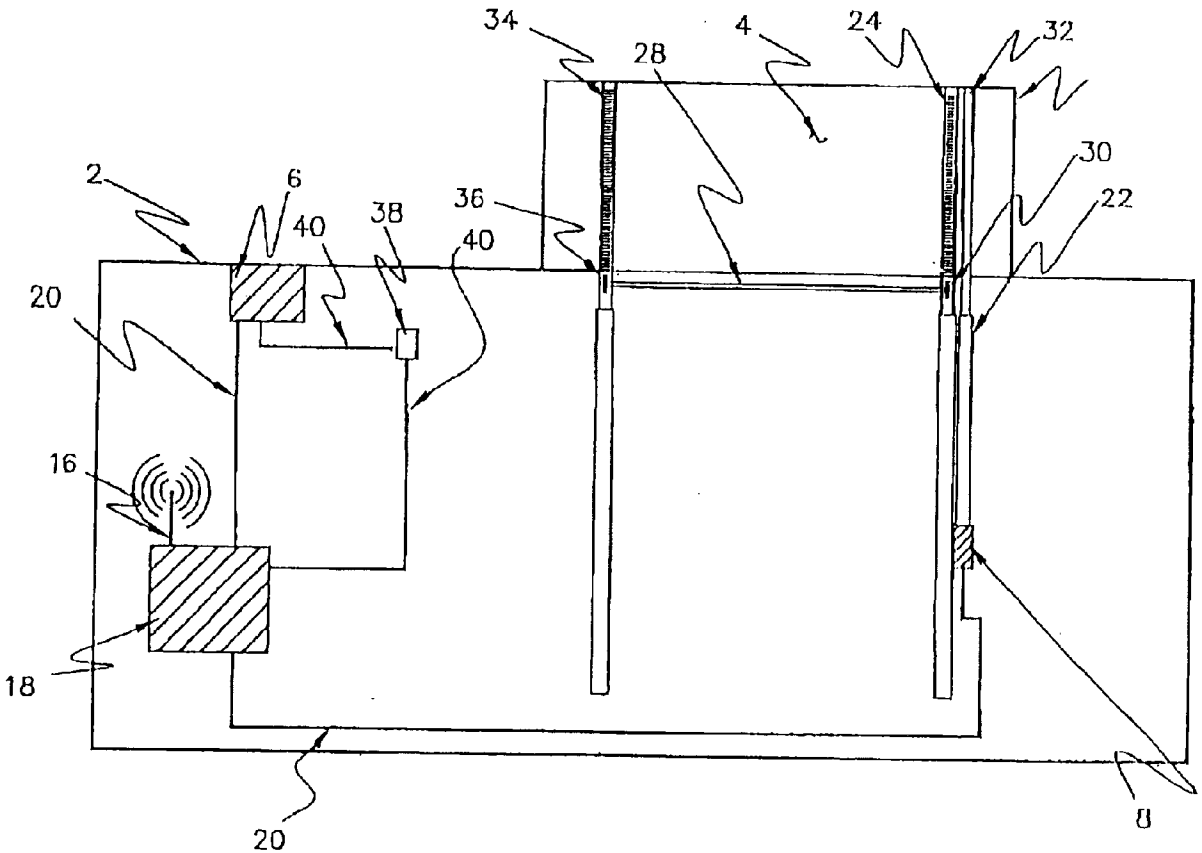
FIG. 1
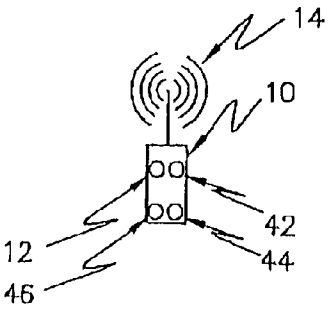

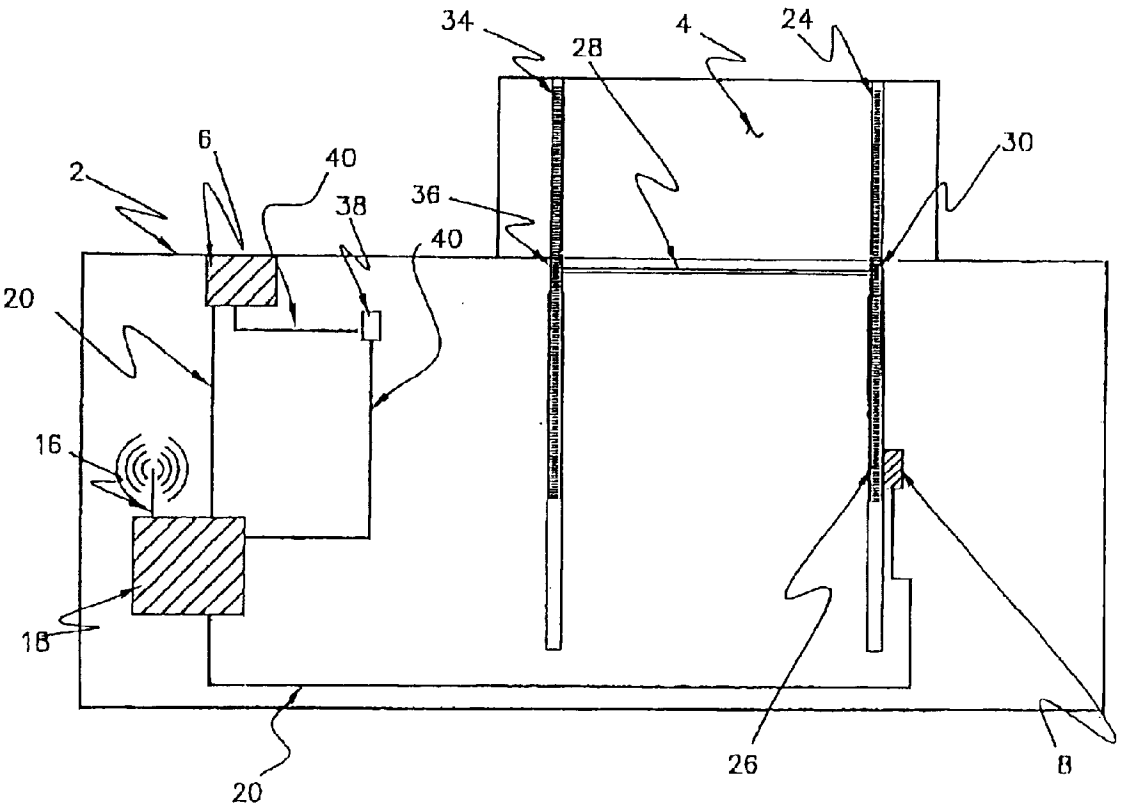
FIG. 3
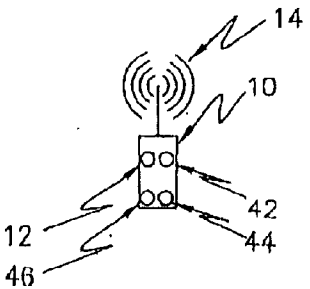

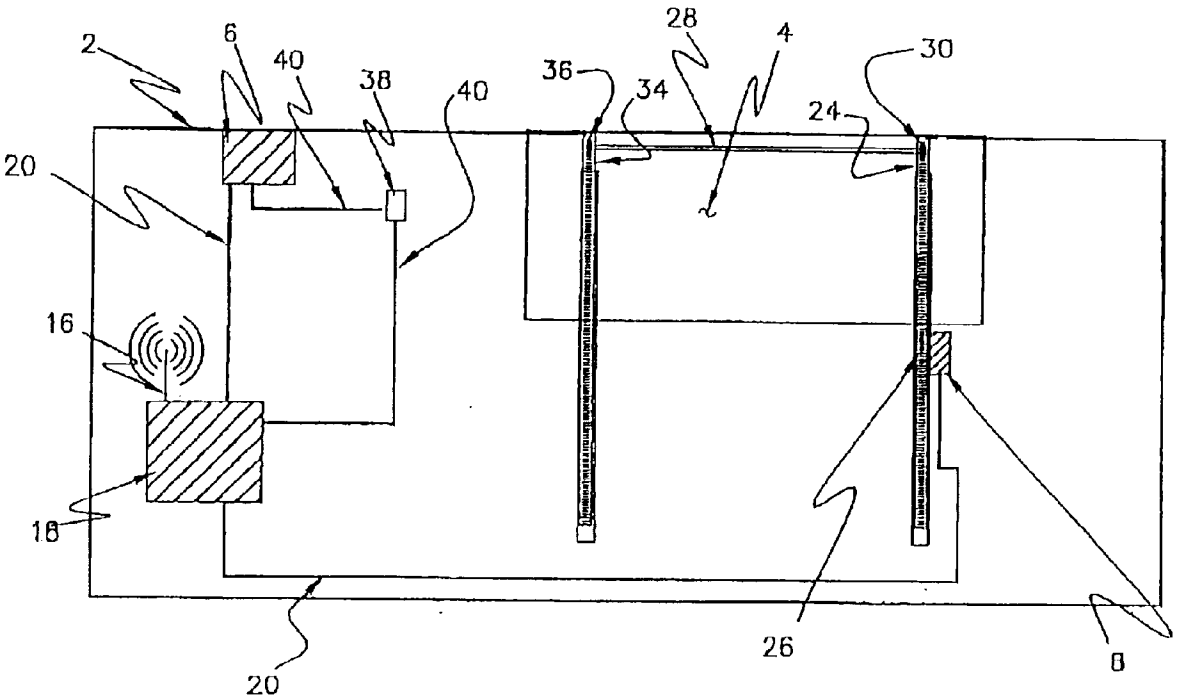
FIG. 4
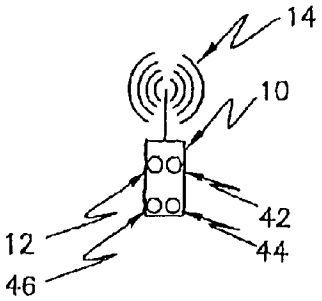

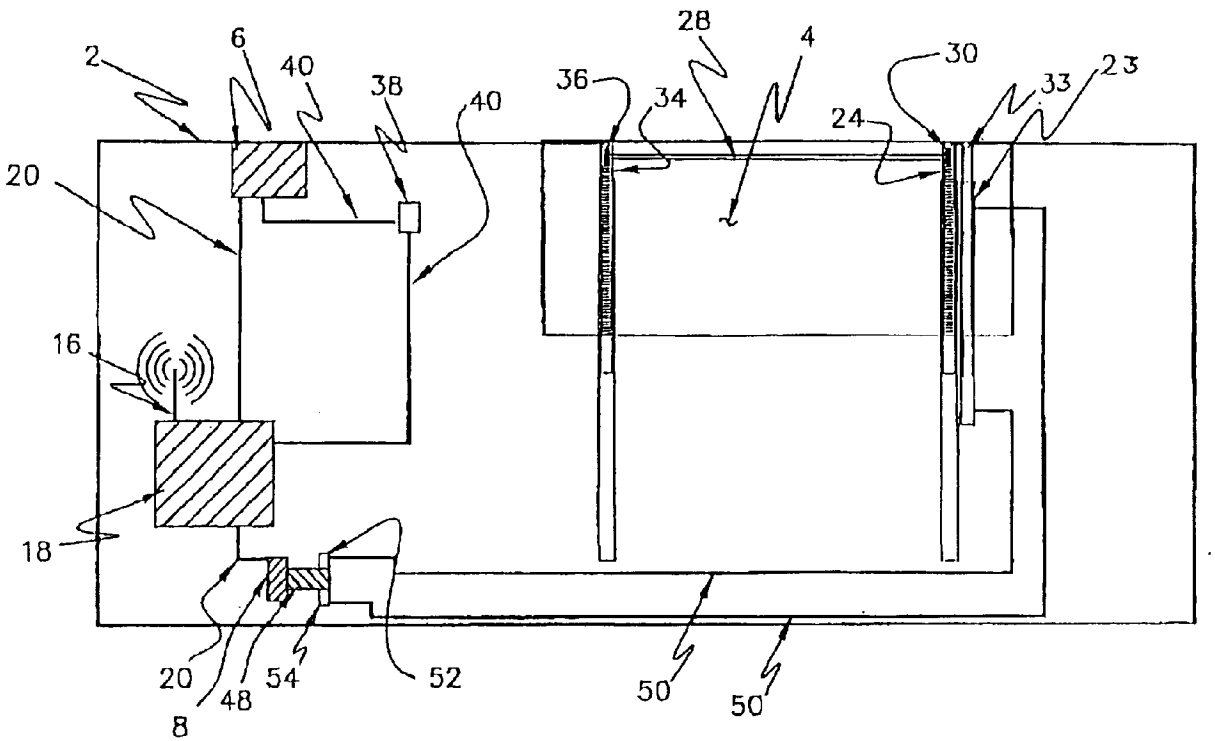
FIG. 6
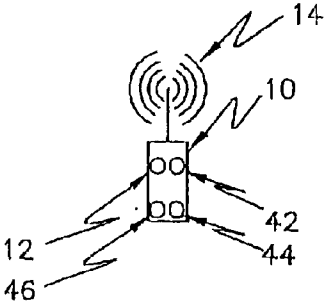

MOTOR CONTROL FOR SLIDE-OUT ROOM IN MOBILE LIVING QUARTERS

This Application claims the benefit of Provisional U.S. Patent Application No. 60/406,270, filed 27 Aug. 2002.

FIELD OF THE INVENTION

The invention relates to mobile living quarters such as recreational vehicles with one or more slide-out rooms.

BACKGROUND OF THE INVENTION

Slide-out rooms are a desirable feature of a recreational vehicle because the interior space is greatly increased by the extension of the rooms, and when retracted the exterior width of the vehicle allows for travel on public roads. Presently, extending and retracting a slide-out room is accomplished either with a manual mechanical device, such as a hand crank for example, or by an electrically powered system. With a manual system, the operator releases a mechanical locking mechanism on the slide-out room and then manually urges it into the desired position. The mechanical locking mechanism is then re-engaged to prevent further movement of the slide-out room. With the electrically powered systems, the operator must generally initiate the movement of the slide-out room by activating a switch located on the interior of the mobile living quarters. The switch causes an electric current to be directed to an electric motor or hydraulic solenoid valves and pumps. The electro-mechanical or electro-hydraulic drive devices then cause the slide-out room to be shifted between its extended and retracted positions.

A problem with the presently known electrical control systems, however, is that the operator often can not effectively monitor the movement of the slide-out room relative to exterior objects, such as trees or other vehicles. This creates a risk that the slide-out room could detrimentally impact on exterior object because the operator misjudged a distance. Therefore, it would be desirable to have a way to electrically control the extension or retraction of a slide-out room in a mobile living quarters from a position in which the operator may readily monitor the position of the slide-out room relative to exterior objects.

SUMMARY OF THE INVENTION

A motor control for a mobile living quarters having a slide-out room includes a radio transmitter for emitting signals, a receiver for receiving signals sent by the transmitter, a switching device activated in response to the receiver, and an electrical actuator for causing the slide-out room to extend or retract. The switching device controls the power for activating the actuator. In one embodiment, the switching device also controls the polarity of the current to the actuator to determine whether the actuator urges the slide-out room into its extended position or its retracted position. In another embodiment, the motor control is adapted to control the extension and retraction of a plurality of slide-out rooms.

An object of the invention is to allow the operator to monitor the motion of the slide-out room from either the interior or exterior of the mobile living quarters at a position the operator chooses as most advantageous.

Another object of the invention is to allow the electrical control circuits for operating the slide-out room to be installed before the vehicle structure is assembled, and to provide a control apparatus that is simpler and less time consuming to install.

Another object of the invention is to provide an electric activation switch for a slide-out room that may be permanently located in a larger variety of locations without being restricted by the requirements of a wiring harness between the switch and the actuator for shifting the slide-out room.

Anther object of the invention is to provide a safety mechanism by which the slide-out room cannot be shifted with the electric activation switch when the ignition switch of the vehicle is on.

Another object of the invention is to eliminate the electrical faults that often occur in slide-out room control systems between the operator switch and the drive motor as a result of the electrical conductors being damaged by mechanical fasteners.

Another object of the invention is to provide a slide-out room control system that allows both electrical operation and manual mechanical operation of the devices that urge the slide-out room between its extended and retracted positions.

Another object of the invention is to provide a control system which may be installed as the sole control system for the slide-out room or may be installed as an additional control system to a previously installed conventional control system.

BRIEF DESCRIPTION OF THE DRAWINGS

These and other aspects of the invention will be apparent from the following description, with reference to the accompanying drawings, in which:

FIG. 1 is a schematic diagram of the control system adapted for use with a slide-out room driven between its extended and retracted positions by a worm screw, the slide-out room in its extended position;

FIG. 3 is a schematic diagram of the control system adapted for use with a slide-out room driven between its extended and retracted positions by a gear or cog, the slide-out room in its extended position;

FIG. 4 shows the control system of FIG. 3 with the slide-out room in its retracted position;

FIG. 6 shows the control system of FIG. 5 with the slide-out room in its retracted position;

Corresponding reference characters indicate corresponding parts throughout the several figures.

DETAILED DESCRIPTION

Figure 2:
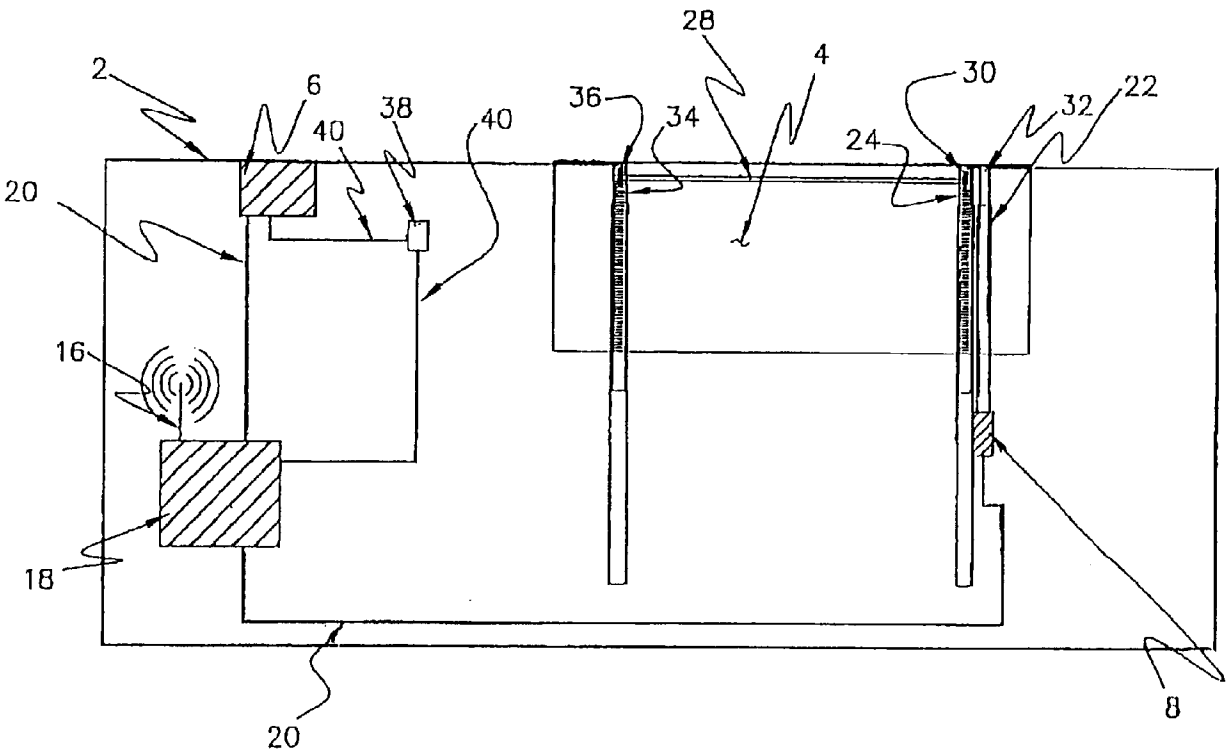
FIG. 2 shows the control system of FIG. 1 with the slide-out room in its retracted position.
Figure 2:
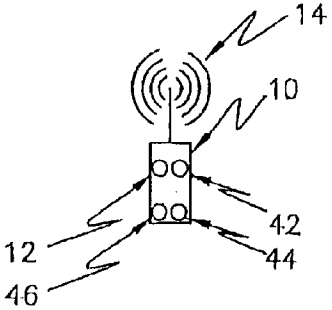

Referring now to FIGS. 1 and 2, a recreational vehicle 2 is shown with a slide-out room 4 securely attached to the outboard ends of slide support tubes 24, 34. A linear actuator 22 uses a threaded rotating shaft driven by an electric motor 8 to urge slide-out room 4 between its extended and retracted positions. When sufficient electrical current is supplied to motor 8, the motor rotates the screw shaft within linear actuator 22. A movable inner sleeve 32 in linear actuator 22 threadedly engages the screw shaft and is secured to a slide support tube 24. As the screw shaft within linear actuator 22 rotates, movable inner sleeve 32 is extended or retracted within the linear actuator, depending on the direction the screw shaft is rotating. The rotational direction of the shaft is determined by the polarity—positive or negative—of the electrical current in the circuit supplying power to motor 8. Slide-out room 4 is shifted from its extended position to its retracted position by reversing the polarity in the circuit from the power cycle used to extend slide-out room 4.

A fixed slide-out alignment shaft 28 transmits movement of slide support tube 24 to the opposite slide support tube 34 in order to move slide-out room 4 in a uniform manner. Support tube 24 includes a rack gear which engages and rotates pinion gear 30 connected to slide-out alignment shaft 28 to generate a torsional force in the slide-out alignment shaft when support tube 24 is linearly shifted. The torsional force is carried by shaft 28 to another pinion gear 36 connected to the opposite end of the shaft. Pinion gear 36 engages a rack gear carried by slide support tube 34 to move it in synchronized motion with slide support tube 24.

A transmitter 10 and a receiver-switching unit 18 are used to control the extension and retraction of slide-out room 4. In order to control the movement of slide-out room 4, DC current from a battery 6 is switched either on or off, and the polarity of the current to motor 8 may be selected to cause the motor to rotate in one direction or the other. When switch 12 on a remote transmitter 10 is closed, a radio frequency (RF) signal 14 is emitted from the transmitter's antenna to an antenna 16 located on a receiver-switching unit 18. Signal 14 is directed from antenna 16 to a logic circuit with receiver-switching unit 18 where the output channel and polarity are determined based on the signal received. The output channel from the logic circuits activates power relays in receiver-switching unit 18, which allows current from battery 6 to be carried through conductors 20 to motor 8, thereby causing shifting of linear actuator 22. When switch 12 on remote transmitter 10 is opened, the transmitter stops transmitting signal 14. Receiver-switching unit 18 then terminates the current to motor 8, thereby causing linear actuator 22 to stop shifting.

The power relays located within receiver-switching unit 18 are connected to both conductors of motor 8. When switch 12 on remote transmitter 10 is closed a second time, the same sequence of events as previously described occurs, except that the logic circuit in receiver-switching unit 18 reverses the polarity of the current sent to motor 8 from the previous power cycle, which causes the motor to move slide-out room 4 in the opposite direction. In this manner, each successive power cycle initiated from transmitter 10 cause the slide-out room to alternatingly extend or retract.

In addition to the above described radio control of motor 8, slide-out room 4 may be extended or retracted by activating the motor with bypass switch 38. When bypass switch 38 is closed, current is carried by conductors 40 into receiver-switching unit 18, where it bypasses the RF signal receive function and activates the logic circuit in the same manner as the receiver output circuit.

Figure 12:
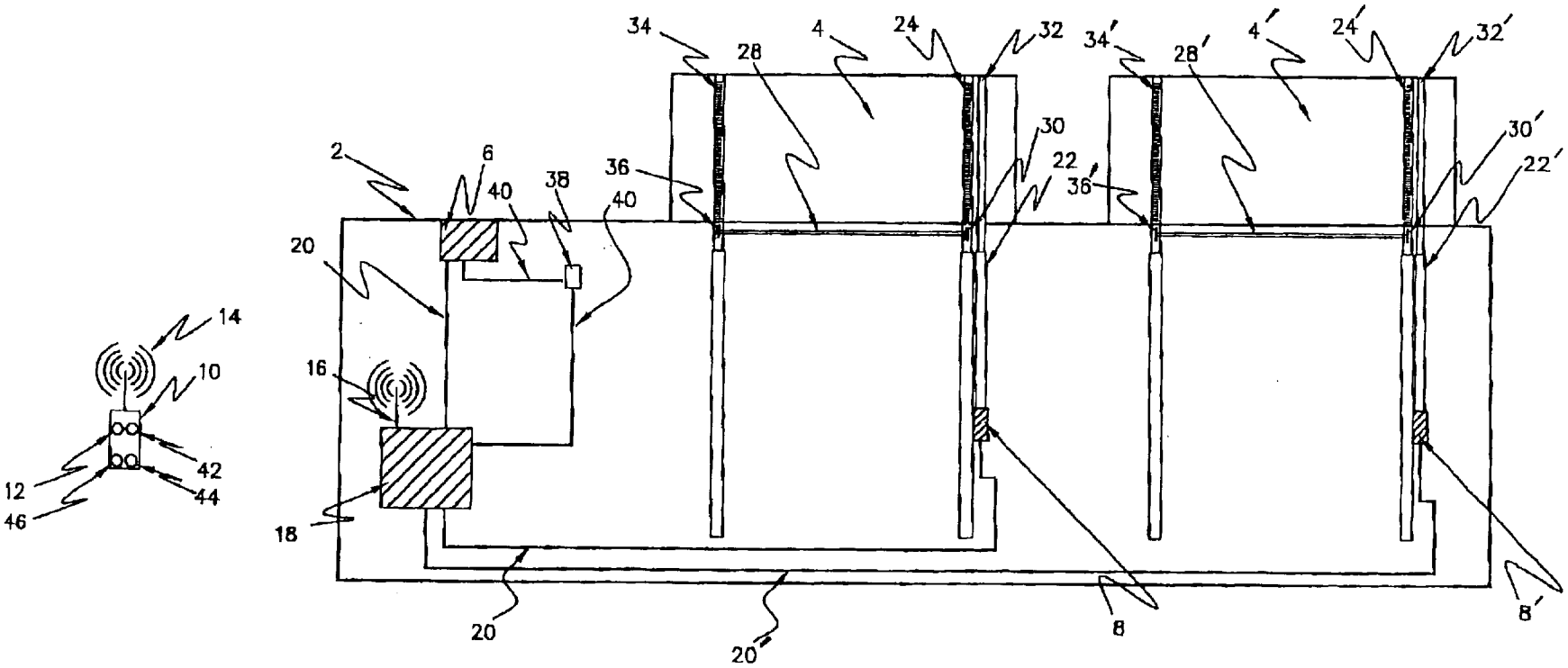
FIG. 12 is a schematic diagram of the control system of FIG. 1 adapted for use with a pair of slide-out rooms.

In order to control more than one slide-out room, transmitter 10 may be adapted for controlling another slide-out room 4' as depicted in FIG. 12. Additional switches 42, 44, and 46 on transmitter 10 are each adapted to transmit a different RF signal having a discrete code or signal signature, and receiver-switching unit 18 is adapted to identify each different signal. When the appropriate RF signal is received by receiver-switching unit 18 by pressing one of switches 42, 44, 46, a current is transmitted through conductors 20' to a motor 8' which in turn causes a linear actuator 22' to extend or retract an inner sleeve 32'. A rack gear on inner sleeve 32' causes pinion gear 30' to rotate a shaft 28' with a second pinion gear 36' engaging a rack gear on support tube 34', which then simultaneously extends or retracts the support tube 34'. The components for the second slide-out room 4' designated by a number with a prime correspond to the same numbered components as in FIG. 1. Additional slide-out rooms or other devices could be controlled, with the other of the switches 42, 44, 46 being adapted for controlling the additional devices in a similar manner. Alternatively, a separate receiver-switching unit could be used for the additional slide-out room, with each of the receiver-switching units being tuned to receive a different one of each of the different signals transmitted by transmitter 10.

Turning now to FIGS. 3 and 4, another slide-out room 4 is shown as already described, except that slide tube 24 is driven by a pinion gear 26 driven by motor 8 and engaged with the rack gear carried by slide tube 24 instead of a screw shaft and sliding sleeve. As before, motor 8 is driven either in forward or reverse rotation as dictated by the polarity of the current supplied from battery 6. Transmitter 10 and receiver-switching unit 18 interact in the same manner as herein before described to cause motor 8 to either extend or retract slide-out room 4. Additional switches 42, 44, 46 on transmitter 10 may be adapted to activate additional motor control circuits for other control systems as already described.

Figure 5:
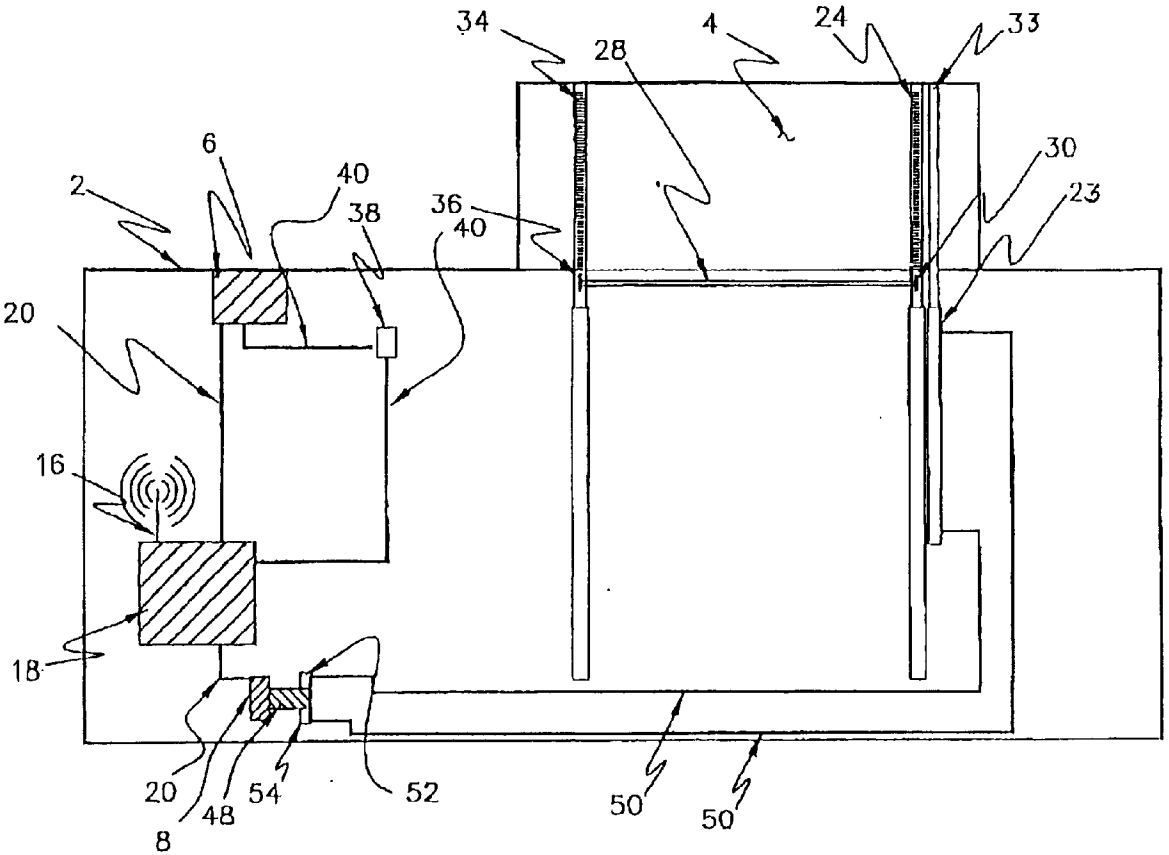
FIG. 5 is a schematic diagram of the control system adapted for use with a slide-out room driven between its extended and retracted positions by a hydraulic system, the slide-out room in its extended position.
Figure 5:
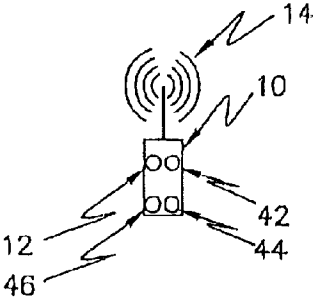

Turning now to FIGS. 5 and 6, a third slide-out room 4 is shown as already described, except that extension and retraction of the slide-out room is driven by a hydraulic system instead of a mechanical system. In this embodiment, an electrically driven hydraulic pump 48 actuates a hydraulic cylinder 23 through interconnecting hydraulic hoses or lines 50. Electric current supplied to motor 8 causes the motor to drive hydraulic pump 48, which pumps hydraulic fluid through lines 50 to either extend or retract a movable shaft or piston 33 within hydraulic cylinder 23. The direction of motion of shaft 33 depends on the direction of flow of the hydraulic fluid through lines 50. For example, when hydraulic fluid is pumped in one direction, piston 33 will extend; when hydraulic fluid is pumped in the opposite direction, piston 33 will retract. When motor 8 is electrically powered, the attached hydraulic pump 48 pressurizes hydraulic lines 50. A pair of solenoid valves 52, 54 in hydraulic lines 50 are electrically activated to control the direction of flow within the hydraulic lines. Piston 33 of hydraulic cylinder 23 is secured to slide support tube 24. As piston 33 is extended or retracted, slide support tube 24 also extends or retracts. In this manner, slide-out room 4 is either extended or retracted by hydraulic cylinder 23 and piston 33.

In order to control the actuation of the hydraulic system, DC power from battery 6 must be switched on and off to control hydraulic pump 48, and hydraulic solenoid valves 52, 54 must be opened and closed as required to provide the necessary direction of flow of the hydraulic fluid within hydraulic lines 50 for extending or retracting piston 33. As before, transmitter 10 transmits an RF signal 14 to receiver antenna 16 when switch 12 is closed. When signal 14 is received, the logic circuit within receiver-switching unit 18 causes the proper output channels to be activated to power the appropriate relays for powering motor 8 and the appropriate connection of one hydraulic solenoid valve 52, 54 to the outlet of pump 48 and the connection of the other hydraulic valve 52, 54 to the inlet of the pump. As before, the logic circuit causes each successive power on cycle shift slide-out room 4 in the opposite direction as the previous power on cycle. This is accomplished by alternating which hydraulic solenoid valve is connected to the outlet and inlet of pump 48 during each successive power on cycle, thereby causing the direction of flow of the hydraulic fluid to alternate. Additional motor control circuits for additional slide-out room actuators may be controlled by transmitter 10 and receiver-switching unit 18 as herein before described.

Figure 7:
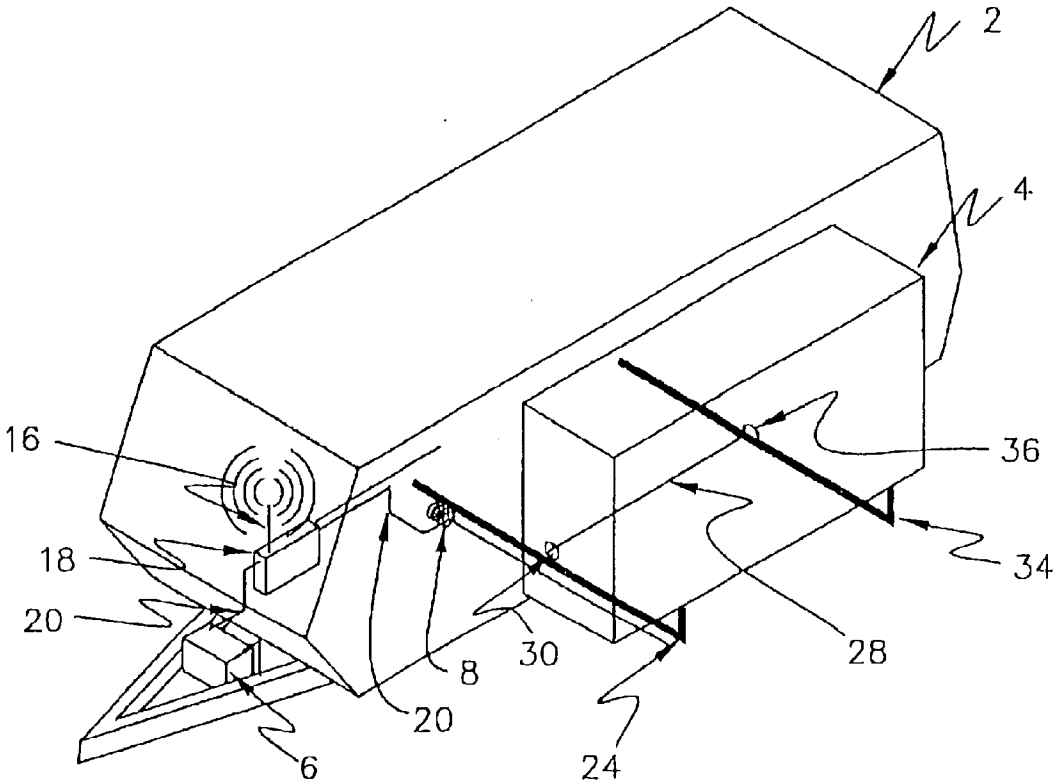
FIG. 7 is a diagram of the control system as it would typically be installed on a typical towed recreational vehicle having the slide-out room drive systems of any of FIGS. 1, 3, or 5.
Figure 7:
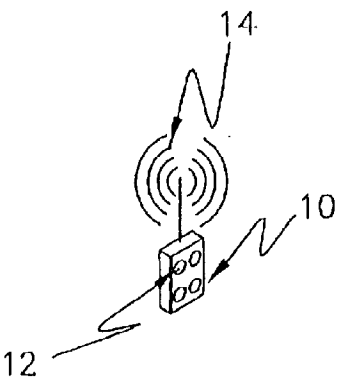
Figure 8:
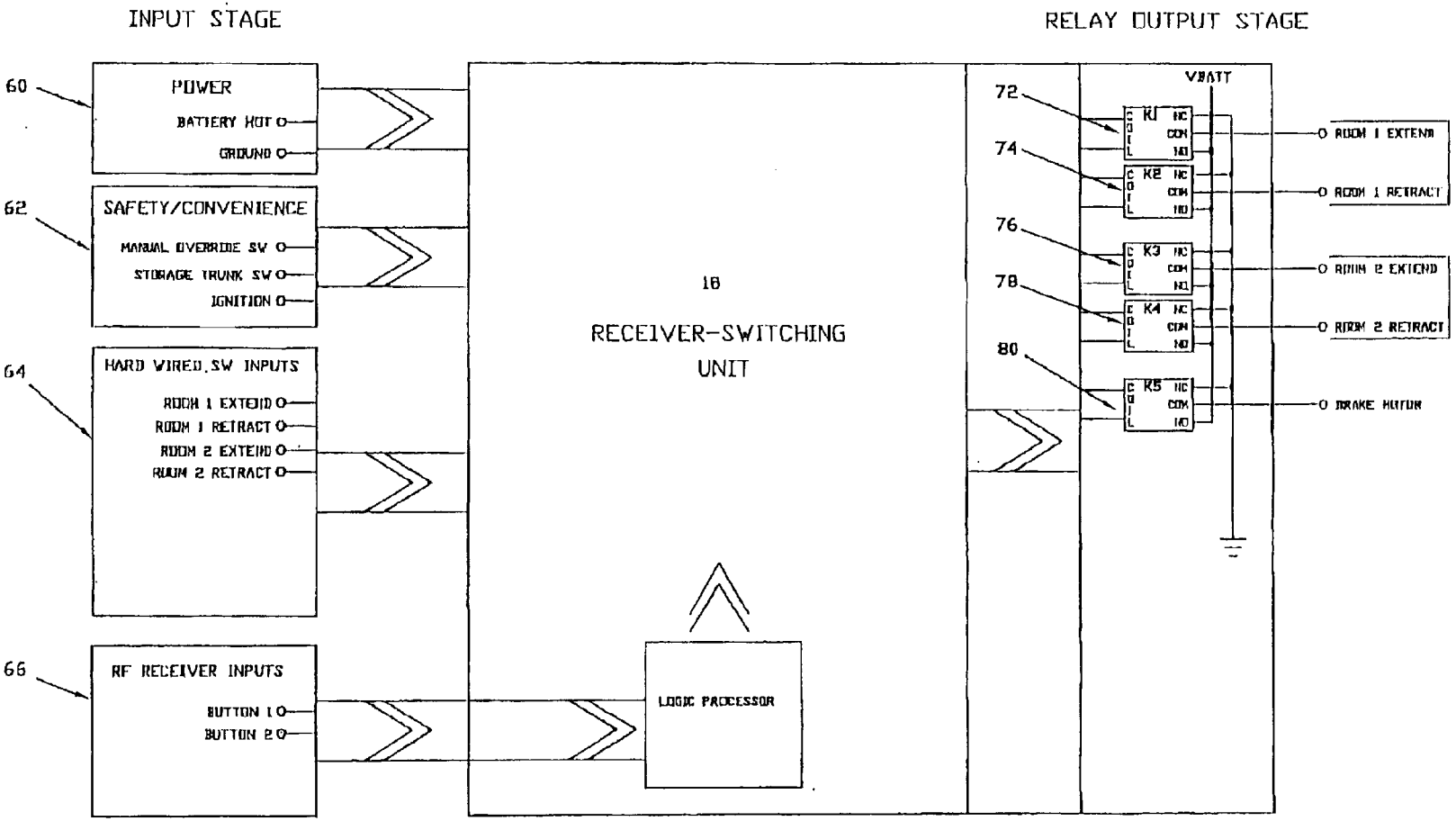
FIG. 8 is a schematic diagram of the circuitry in the receiver used with a two-button transmitter for controlling the systems in FIGS. 1–4.

In FIG. 7, a preferred arrangement of the components in a recreational vehicle 2 is shown. Transmitter 10 is located exterior of recreational vehicle 2. Transmitter 10 may be either secured to an associated object, such as the towing vehicle, or it may be remote. Receiver-switching unit 18 is preferably carried inside recreational vehicle 2 to protect it from the elements, although it could be carried outside the vehicle if sealed from the elements. Battery 6 is carried by the vehicle. Appropriate wiring of conductors 20 connects battery 6 to receiver-switching unit 18 and motor 8 to allow the slide-out room 4 to be extended and retracted as herein before described. Transmitter 10 and antenna 16 must be located near enough each other to allow RF signal 14 to be adequately received by receiver-switching unit 18 to activate its logic circuits.

Various embodiments of receiver-switching unit 18 are schematically detailed in FIGS. 8–11. Inputs 60, 62, 64, 66 allow various electrical signals to enter receiver-switching unit 18. Power from battery 6 enters input 60. Inputs for several wired switches are provided in receiver-switching unit 18 at 62, 64. Safety and convenience switches at input 62 include a manual override switch and ignition and storage trunk safety switches. The manual override switch allows the slide-out room to be extended or retracted by manually rotating motor 8, such as with a hand crank for example. The ignition and storage trunk safety switch inputs provide for a safety interlock that disables the activation of motor 8 in the event the ignition on the towing vehicle is on or a trunk door on the towing vehicle is positioned such that normal operation of the slide-out room is impeded. Inputs at 64 include manual switches wired directly to receiver-switching unit 18 in order to operate one or two slide-out rooms independently of transmitter 10 by bypassing the receiver circuitry at switch 38 as previously described. Inputs at 66 in receiver-switching unit 18 receive input from transmitter 10. Switches 12, 42, 44, 46 on transmitter 10 provide this input through discrete RF inputs at input 66.

The power to output relays 72, 74, 76, 78, 80 from battery 6 is controlled by the programmed logic contained within receiver-switching unit 18. Relays 72, 74, 76, and 78 determine the power and polarity to the specific motors used to move the slide-out rooms. Relay 80 enables those systems using an electro-mechanical brake associated with motor 8 for the slide-out room. When power is sent to a motor through the activation of one of the motor relays 72, 74, 76, or 78, the electro-mechanical brake will be disengaged to allow extension or retraction of the slide-out room.

Figure 9:
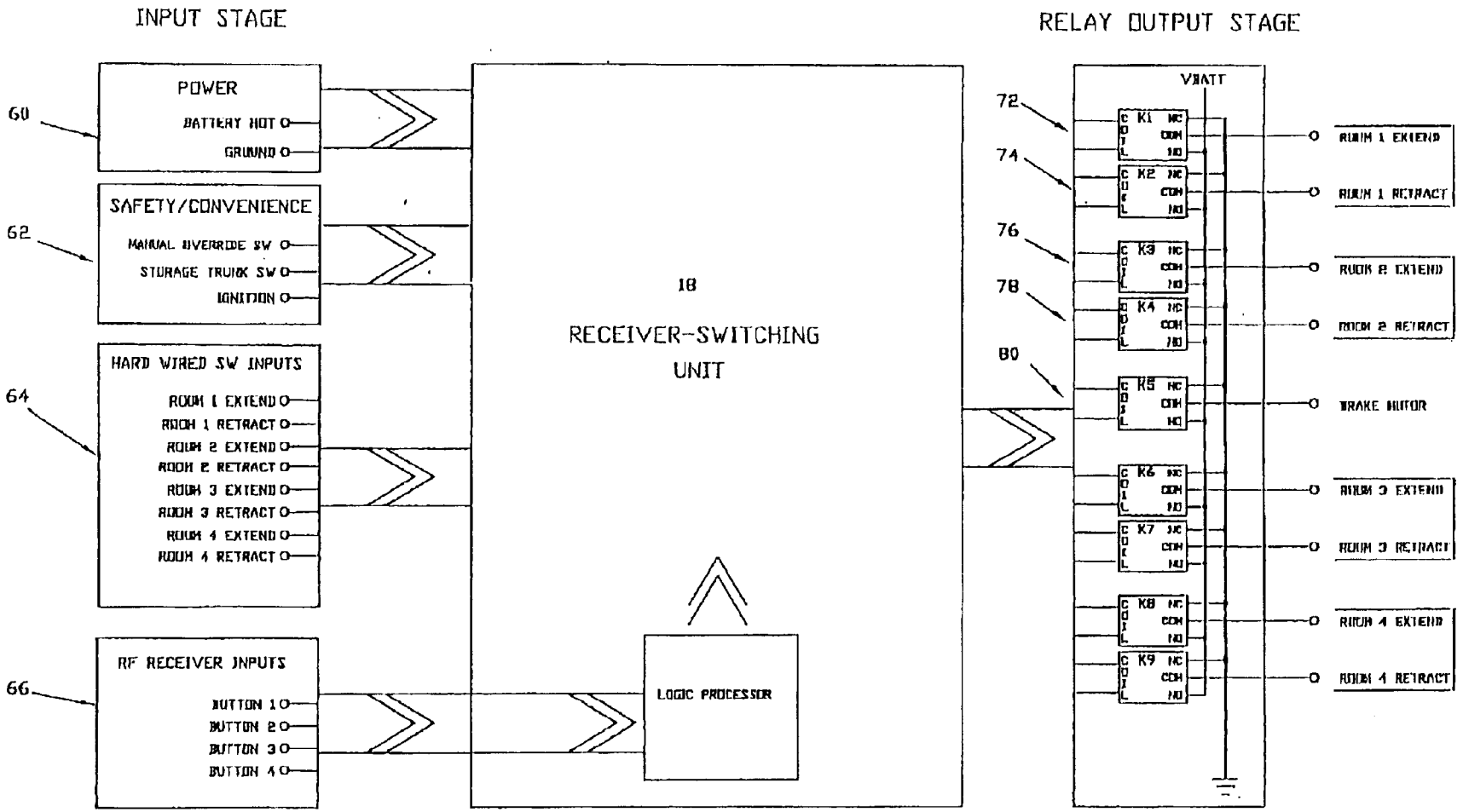
FIG. 9 is a schematic diagram of the circuitry in the receiver used with a four-button transmitter for controlling the systems in FIGS. 1–4.

Additional motor channels can be added to receiver-switching unit 18 as shown in FIG. 9. Appropriate programmed logic contained within receiver-switching unit 18 allows different signals sent from the different switches 12, 42, 44, 46 on transmitter 10 to control different motors on different slide-out rooms.

Figure 10:
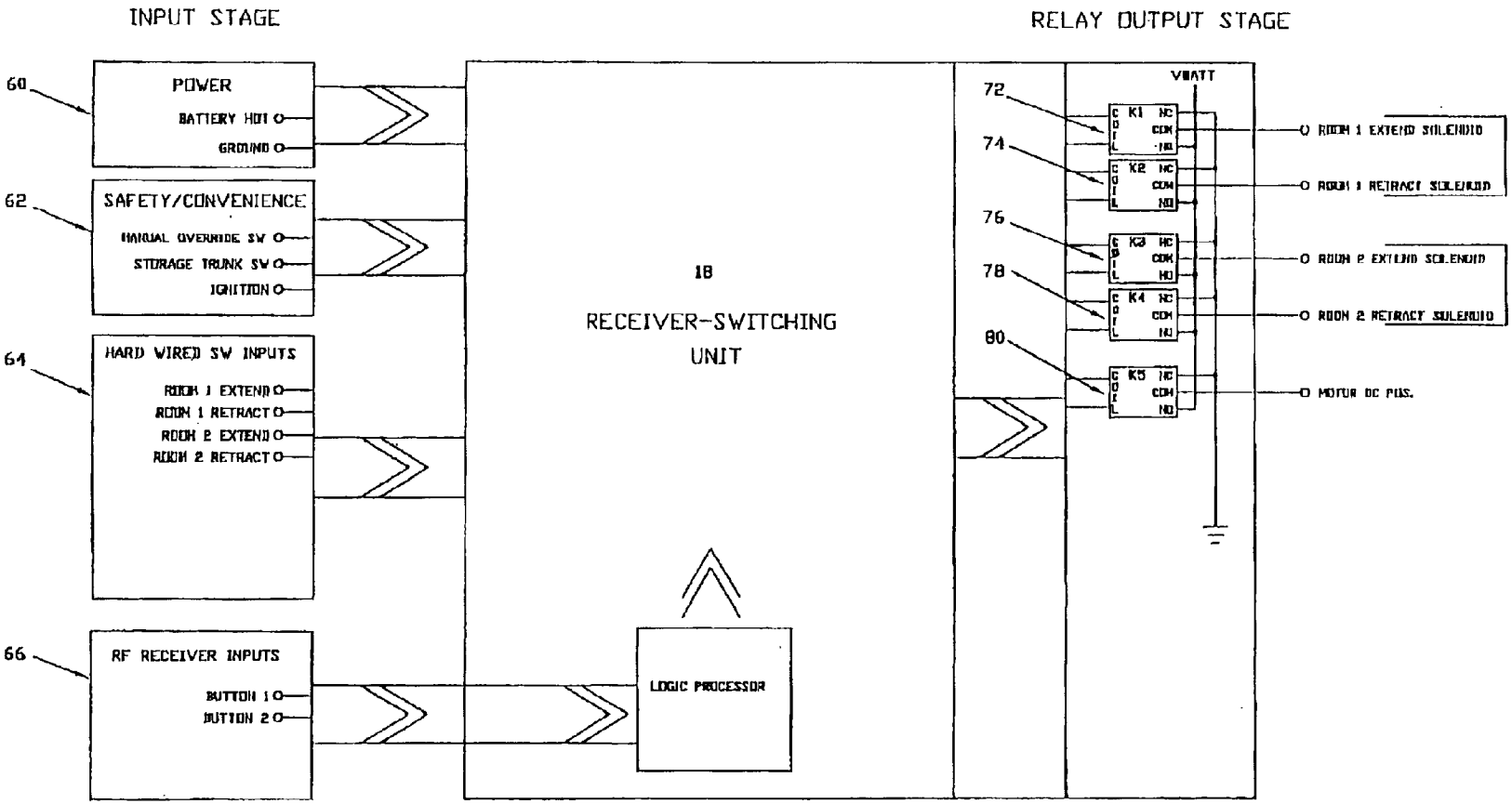
FIG. 10 is a schematic diagram of the circuitry in the receiver used with a two-button transmitter for controlling the system in FIGS. 5–6.
Figure 11:
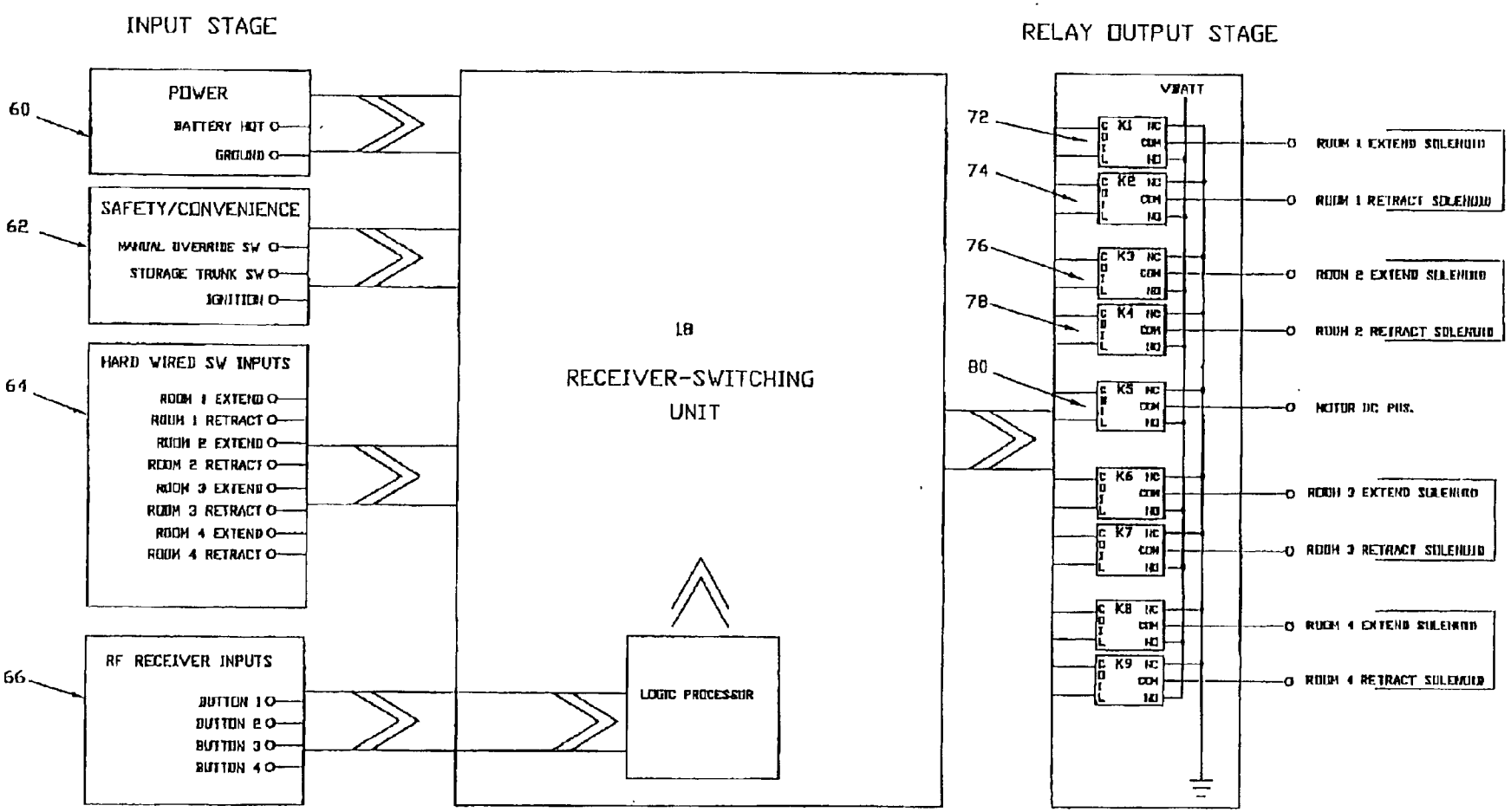
FIG. 11 is a schematic diagram of the circuitry in the receiver used with a four-button transmitter for controlling the system in FIGS. 5–6.

Receiver-switching unit 18 can also be adapted as shown in FIGS. 10 and 11 to operate a hydraulic slide-out room actuation system as described above. Receiver-switching unit 18 may be adapted for controlling a single slide-out room as shown in FIG. 10, or it may be adapted for controlling multiple slide-out rooms as shown in FIG. 11. In the electro-hydraulic systems, relays 72, 74, 76, and 78 are used to activate the necessary solenoid valves rather than the motors as described for the previous embodiments. Relay 80 is used to switch power on and off to the motor for the hydraulic pump rather than an electro-mechanical brake.

The detailed description hereinbefore related is only meant to exemplify the invention to enable those skilled in the art to make and use it. It is not intended to be a limitation from other minor and obvious variations on the embodiments described, all of which variations are expressly included herein. Although the detailed description only addresses motors used to extend and retract slide-out rooms, the control system is not limited to being used solely for slide-out rooms. Adaptation of the control system for use with other systems requiring activation/deactivation control is also anticipated.

I claim:

1. A motor control for a mobile living quarters having a slide-out room, said control comprising a remote transmitter for emitting a coded radio frequency signal, a receiver mounted to said mobile living quarters for receiving said signal and in response thereto activating a switching device, an actuator responsive to an electrical current for causing said slide-out room to shift between a retracted position within said mobile living quarters and an extended position projecting from the mobile living quarters, said switching device for controlling the input and polarity of said electrical current into said actuator, said polarity determining whether said slide-out room is urged by said actuator into its extended position or its retracted position.

2. The motor control of claim 1 wherein said transmitter is for emitting a second coded radio frequency signal, said receiver for receiving said second signal and in response thereto for activating a second switching device to activate a second actuator responsive to another electrical current for causing a second slide-out room to shift between a retracted position within said mobile living quarters.

3. The motor control of claim 1 and a bypass switch connected to said switching device, said bypass switch for activating said switching device independently of said receiver.

4. The motor control of claim 3, said switching device for activating a safety cutoff switch to prevent said slide-out room from shifting between its extended and retracted positions if said switch is in a predefined state.

* * * * *